US009553356B2

(12) United States Patent
Chang et al.

(10) Patent No.: US 9,553,356 B2
(45) Date of Patent: Jan. 24, 2017

(54) ANTENNA MODULE AND WIRELESS COMMUNICATION DEVICE EMPLOYING THE SAME

(71) Applicant: Chiun Mai Communication Systems, Inc., New Taipei (TW)

(72) Inventors: Tze-Hsuan Chang, New Taipei (TW); Cho-Kang Hsu, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 111 days.

(21) Appl. No.: 14/582,645

(22) Filed: Dec. 24, 2014

(65) Prior Publication Data

US 2015/0188234 A1 Jul. 2, 2015

(30) Foreign Application Priority Data

Dec. 31, 2013 (CN) ..... 2013 1 0748988

(51) Int. Cl.

| | |
|---|---|
| ***H01Q 1/24*** | (2006.01) |
| ***H01Q 1/22*** | (2006.01) |
| ***H01Q 7/00*** | (2006.01) |
| ***H01Q 5/378*** | (2015.01) |

(52) U.S. Cl.
CPC ..... *H01Q 1/243* (2013.01); *H01Q 1/2291* (2013.01); *H01Q 5/378* (2015.01); *H01Q 7/00* (2013.01)

(58) Field of Classification Search
CPC ..... H01Q 1/241; H01Q 1/242; H01Q 1/243; H01Q 1/2291; H01Q 5/378
See application file for complete search history.

(56) References Cited

U.S. PATENT DOCUMENTS

| | | | | |
|---|---|---|---|---|
| 7,161,541 | B2 * | 1/2007 | Chen | H01Q 1/243 343/700 MS |
| 7,791,546 | B2 * | 9/2010 | Hotta | H01Q 1/243 343/700 MS |
| 9,356,336 | B1 * | 5/2016 | Zheng | H01Q 5/378 |

* cited by examiner

*Primary Examiner* — Hoang V Nguyen
(74) *Attorney, Agent, or Firm* — Zhigang Ma

(57) ABSTRACT

An antenna module includes a main antenna and a parasitic resonator. The main antenna includes a feed arm, a ground arm, a first radiating body connected to one end of the feed arm, a second radiating body, and a third radiating body connected to one end of the ground arm. The first radiating body and the third radiating body are connected to the second radiating body and positioned at two sides of the second radiating body. The parasitic resonator is resonated with the main antenna and configured for widening a high frequency bandwidth of the main antenna.

19 Claims, 5 Drawing Sheets

ANTENNA MODULE AND WIRELESS COMMUNICATION DEVICE EMPLOYING THE SAME

FIELD

The subject matter herein generally relates to antenna modules, particularly to a multiband antenna module and a wireless communication device using the multiband antenna module.

BACKGROUND

Typical wireless communication devices generally include a single band antenna to transmit and receive electromagnetic waves. The single band antenna only allows transmission and reception of only one frequency band for communication and does not provide the flexibility of using multiple frequency bands suitable for different communication systems. Theoretically, using a different antenna for each frequency band can solve this problem. However, multiple antennas will inevitably increase cost of manufacturing the portable wireless communication devices, and occupy a large space within the portable wireless communication devices.

BRIEF DESCRIPTION OF THE DRAWINGS

Implementations of the present technology will now be described, by way of example only, with reference to the attached figures.

DETAILED DESCRIPTION

Figure 1:
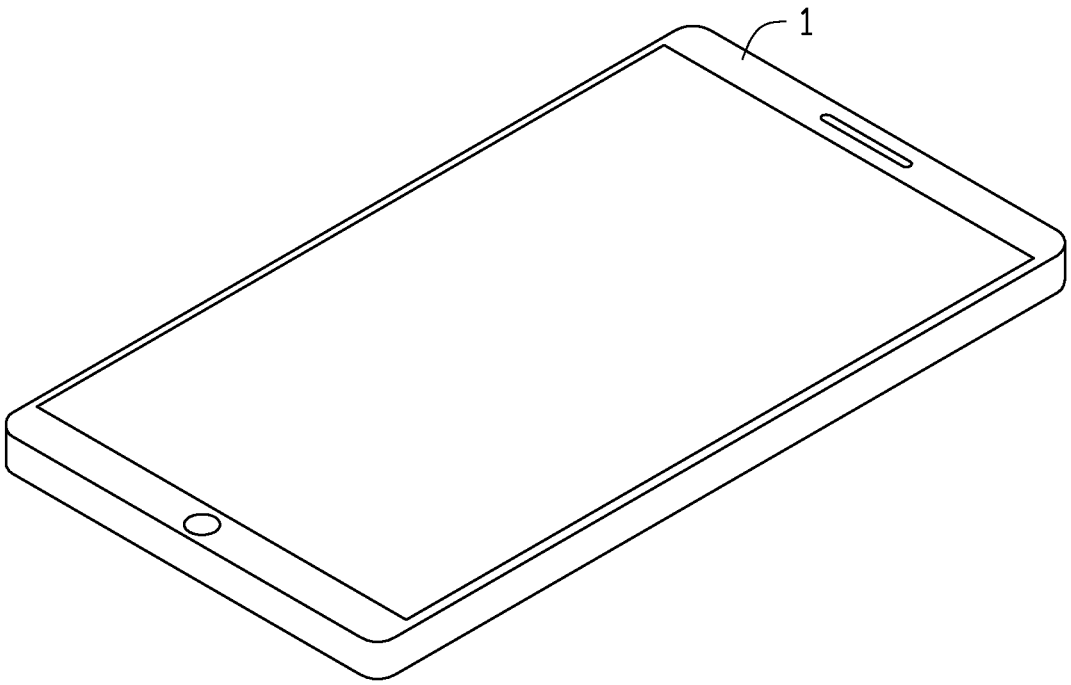
FIG. 1 is an isometric view of a wireless communication device according to an exemplary embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
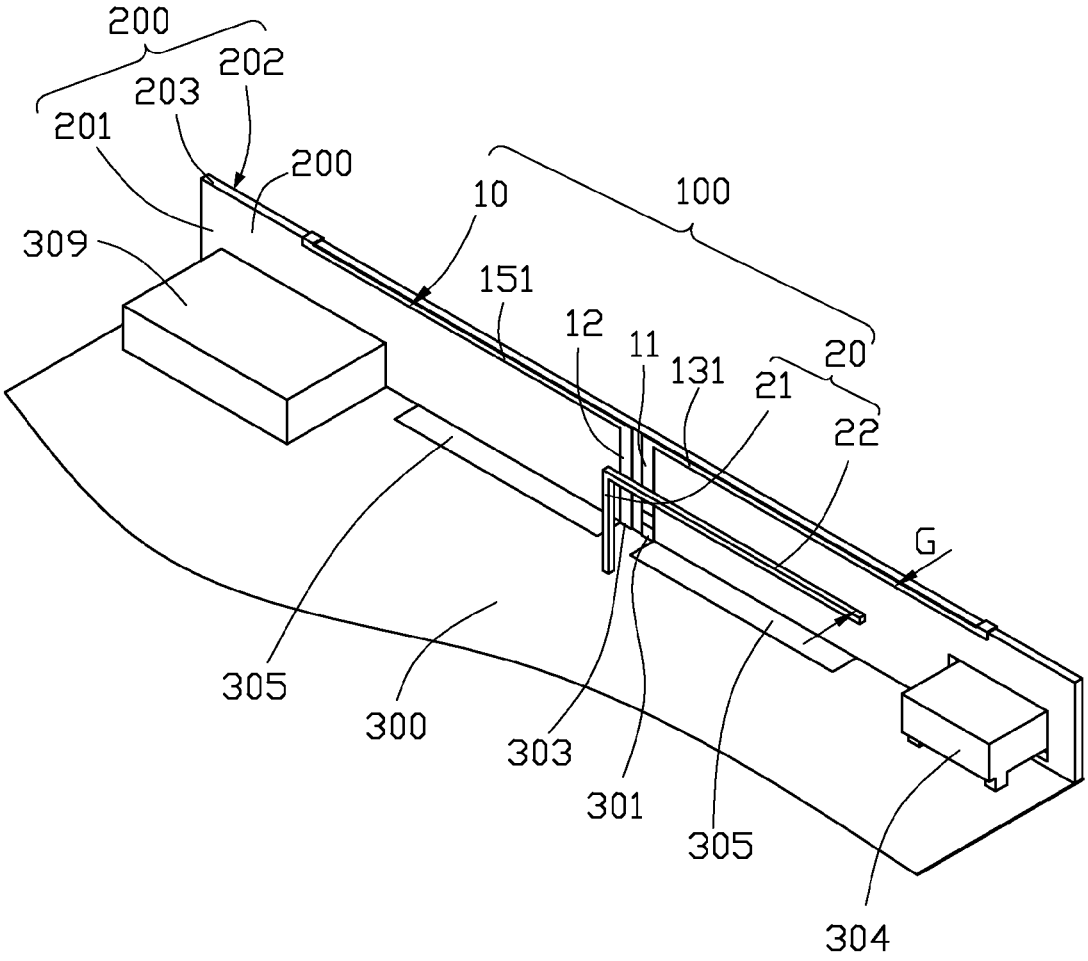
FIG. 2 is a partial, isometric view of the wireless communication device of FIG. 1.

FIG. 1 is an isometric view of a wireless communication device 1 according to an exemplary embodiment. FIG. 2 illustrates the wireless communication device 1 includes an antenna module 100, a base plate 200, and a circuit board 300. The antenna module 100 is assembled to the base plate 200. The base plate 200 is secured on an end of the circuit board 300.

Referring to FIG. 2, the circuit board 300 includes two keep-out-zones 305. The purpose of the keep-out-zone 305 is to delineate an area on the circuit board 300 in which other electronic components (such as a camera, a vibrator, a speaker, etc.) cannot be placed. In at least one embodiment, the keep-out-zones 305 are disposed on the end of the circuit board 300 adjacent to the base plate 200. A feed point 301 and a ground point 303 are positioned between the two keep-out-zones 305 and spaced from each other. An universal serial bus (USB) interface 304 is positioned at one side of the circuit board 300 adjacent to one of the keep-out-zones 305. A speaker 309 is positioned at another side of the circuit board 300 adjacent to another keep-out-zones 305. The base plate 200 includes a first surface 201, a second surface 202 opposite to the second surface 201, and a third surface 203 connected to the first and second surfaces 201, 202.

The antenna module 100 includes a main antenna 10 and a parasitic resonator 20 resonated with the main antenna 10.

Figure 3:
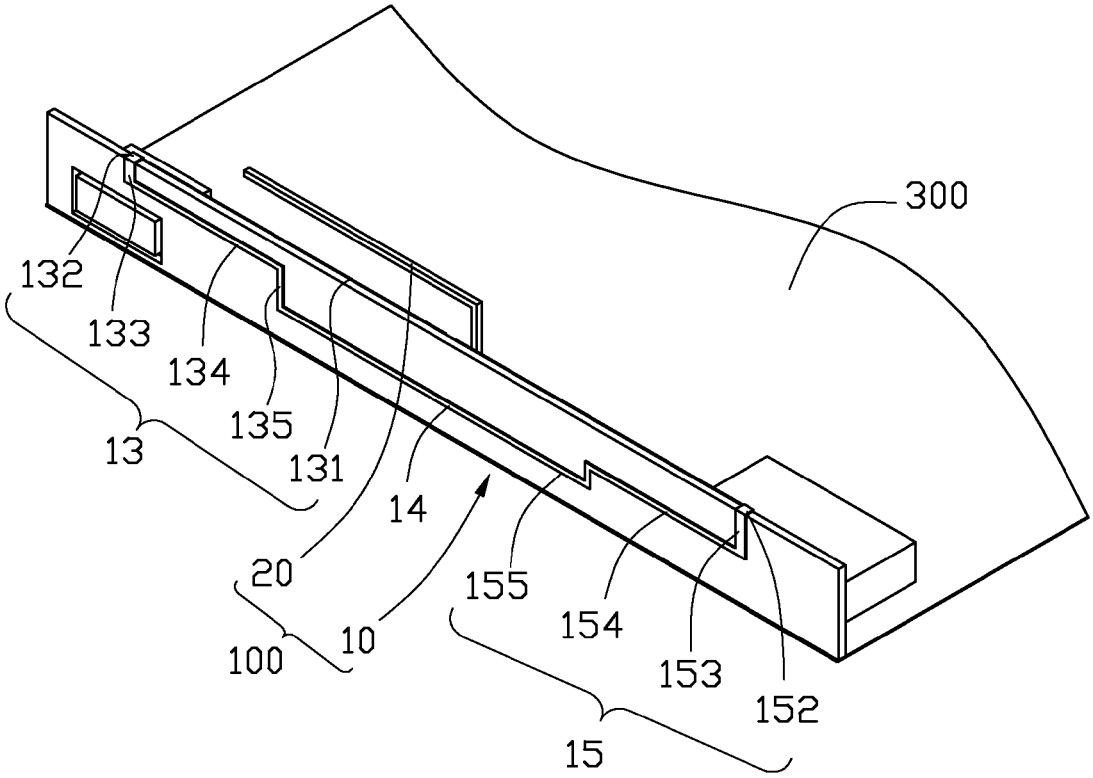
FIG. 3 is similar to FIG. 2, but shown from another angle.

Referring also to FIG. 3, the main antenna 10 includes a feed arm 11, a ground arm 12, a first radiating body 13, a second radiating body 14, and a third radiating body 15.

The feed arm 11 and the ground arm 12 are substantially two strip-shaped sheets parallel to each other. The feed arm 11 and the ground arm 12 are attached to the first surface 201. An end of the feed arm 11 is perpendicularly and electronically connected to the feed point 301 for feeding current to the first, second, and third radiating bodies 13, 14, 15. An end of the ground arm 12 is perpendicularly and electrically connected to the ground point 303 for grounding.

The first radiating body 13 includes a first radiating section 131, a second radiating section 132, a third radiating section 133, a fourth radiating section 134, and a fifth radiating section 135. The first, second, third, fourth, and fifth radiating section 134 are substantially strip-shaped sheets.

The first radiating section 131 is positioned on the first surface 201. An end of the first radiating section 131 is perpendicularly connected to another end of the feed arm 11 opposite to the feed point 301. The third, fourth, and fifth radiating sections 133, 134, 135 are positioned on the second surface 202 and orderly connected with to form a step-shaped structure. The third and fifth radiating sections 133, 135 are perpendicular to the circuit board 300. The fourth radiating section 134 is parallel to the circuit board 300. The fourth radiating section 134 is positioned between the third and fifth radiating sections 133, 135 and connected to the third and fifth radiating sections 133, 135. The second radiating section 132 is attached to the third surface 203.

Two ends of the second radiating section 132 are perpendicularly connected to the first and third radiating sections 131, 133.

The second radiating body 14 is substantially a strip-shaped sheet. An end of the second radiating body 14 is perpendicularly connected to the fifth radiating section 135. Another end of the second radiating body 14 is perpendicularly connected to the third radiating body 15.

The third radiating body 15 includes a sixth radiating section 151, a seventh radiating section 152, an eighth radiating section 153, a ninth radiating section 154, and a tenth radiating section 155. The structure of the third radiating body 15 is substantially similar to that of the first radiating body 13. The sixth radiating section 151 is attached to the first surface, an end of the six radiating section 151 is perpendicularly connected to another end of the ground arm 12; the eighth, ninth, and tenth radiating section 153, 154, 155 are attached to the second surface and orderly connected to form a step-shaped structure; the seventh radiating section 152 is attached to the third surface, two ends of the seventh radiating section 152 are perpendicularly connected to the sixth and eighth radiating sections 152, 153. The difference between the third radiating body 15 and the first radiating body 13 is that lengths of the eighth, ninth, and tenth radiating sections 153, 154, 155 are different from those of the third, fourth, and fifth radiating sections 133, 134, 135 and the sixth radiating section 151 is connected to the ground arm 12. The first radiating body 13 and the third radiating body 15 are symmetrically positioned at two sides of the second radiating body 14.

The parasitic resonator 20 is substantially an L-shaped sheet and includes a first resonating section 21 and a second resonating section 22. The first resonating section 21 is electronically connected to the circuit board 300 to ground. The second resonating section 22 is perpendicularly connected to the first resonating section 21 and parallel to the circuit board 300. The parasitic resonator 20 is positioned in a plane parallel to the base plate 200. A coupling gap G is formed between the parasitic resonator 20 and the main antenna 10.

In use, current orderly flows from the feed arm 11, the first, second, and third radiating bodies 13, 14, 15, and finally to the ground arm 12 to form a current loop so that the main antenna 10 generates a plurality of first high frequency resonance modes and a low frequency resonance mode and operates efficiently within a first high frequency band about 1710 MHz to about 1990 MHz and a low frequency band about 824 MHz to about 894 MHz. In addition, because of the coupling gap G positioned between the parasitic resonator 20 and the main antenna 10, the parasitic resonator 20 couples with the main antenna 10 to generate a second high frequency resonance mode and widen high frequency bandwidth of the antenna module 100. In this exemplary embodiment, the antenna module 100 operates efficiently within a second high frequency band about 1710 MHz to about 2170 MHz so that the antenna module 100 has a relatively wider high frequency bandwidth.

A length of the coupling gap G can be changed to adjust coupling degree between the main antenna 10 and the parasitic resonator 20 so that a bandwidth of the second high frequency band can be adjusted. In addition, a length of the parasitic resonator 20 can be changed to directly adjust the bandwidth of the second high frequency band.

Figure 4:
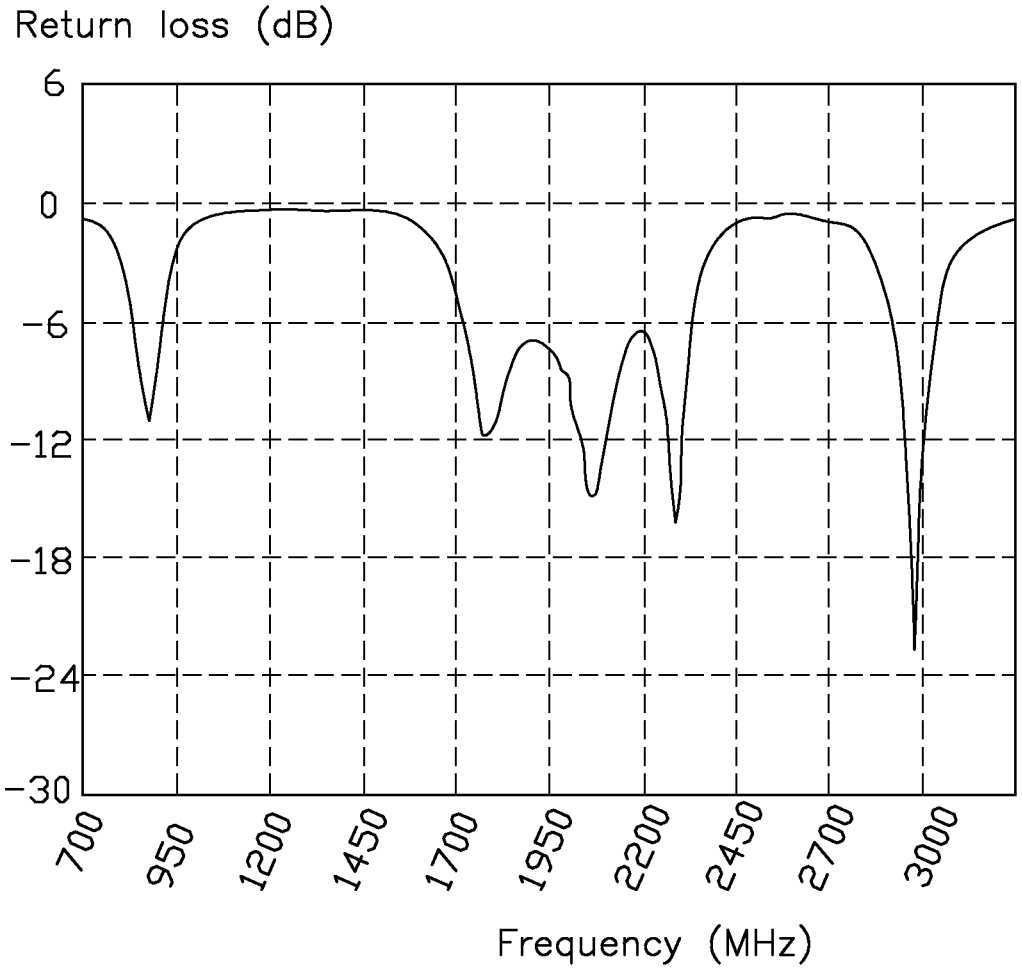
FIG. 4 is a graph illustrating return loss varying with frequency of the wireless communication device of FIG. 1.
Figure 5:
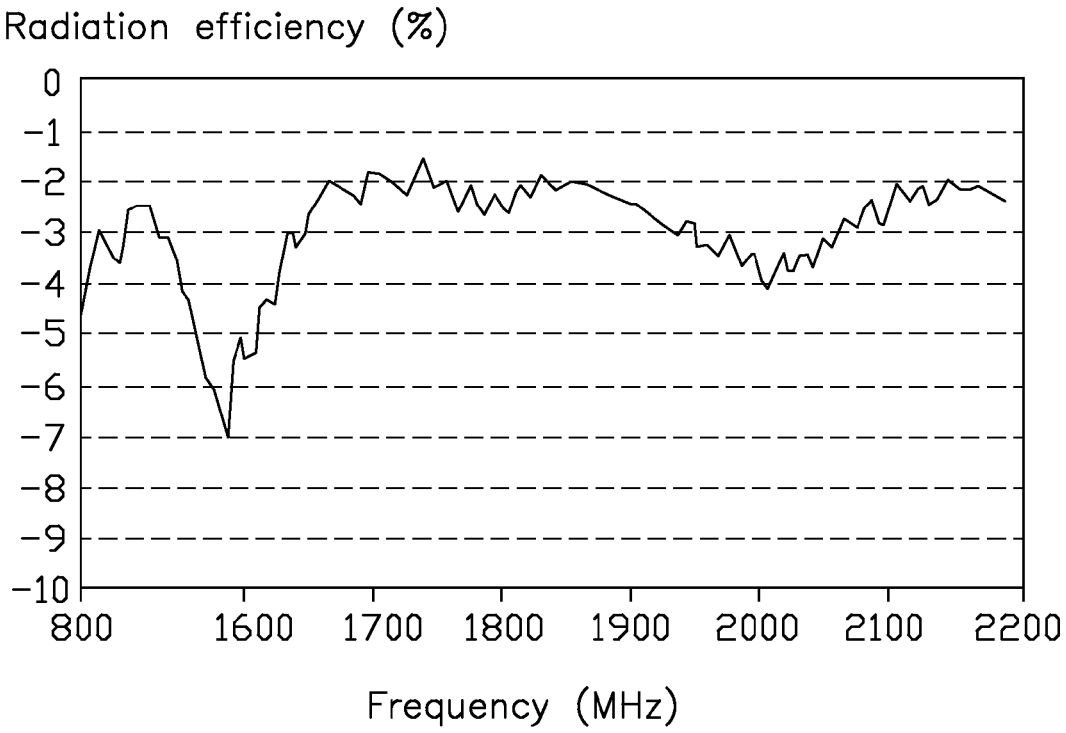
FIG. 5 is a graph illustrating radiation efficiency varying with frequency of the wireless communication device of FIG. 1.

FIGS. 4 and 5 insulate that, according to test results, the antenna module 100 can operate efficiently within the second high frequency band about 1710 MHz to about 2170 MHz and the low frequency band about 824 MHz to about 894 MHz and have a relative better signal transmission and receiving performance.

The high frequency bandwidth of the antenna module 100 are effectively widened from the first high frequency band about 1710 MHz to about 1990 MHz to the second high frequency band about 1710 MHz to about 2170 MHz by coupling effect between the parasitic resonator 20 and the main antenna 10. Therefore, the antenna module 100 does not occupy much space within wireless communication device 1, which is advantageous to miniaturization of the wireless communication device 1.

It is to be understood, however, that even through numerous characteristics and advantages of the present disclosure have been set forth in the foregoing description, together with details of assembly and function, the disclosure is illustrative only, and changes may be made in the details, especially in the matters of shape, size, and arrangement of parts within the principles of the disclosure to the full extent indicated by the broad general meaning of the terms in which the appended claims are expressed.

What is claimed is:

1. An antenna module comprising:

a main antenna comprising:

a feed arm;

a ground arm;

a first radiating body, the first radiating body connected to one end of the feed arm;

a second radiating body; and a third radiating body connected to one end of the ground arm, the first radiating body and the third radiating body connected to the second radiating body and positioned at two sides of the second radiating body; and a parasitic resonator resonating with the main antenna and configured for widening a high frequency bandwidth of the main antenna;

wherein the first radiating body comprises a first radiating section, a second radiating section, a third radiating section, a fourth radiating section, and a fifth radiating section;

wherein the first radiating section is positioned on a first plane, an end of the first radiating section is perpendicularly connected to another end of the feed arm;

wherein the third, fourth, and fifth radiating sections are positioned on a second plane parallel to the first plane and connected to each other to form a step-shaped structure; and wherein two ends of the second radiating section are perpendicularly connected to the first and third radiating sections.

2. The antenna module of claim 1, wherein the second radiating section is positioned on a third plane perpendicular to the first and second planes.

3. The antenna module of claim 2, wherein the second radiating body is substantially a strip-shaped sheet, an end of the second radiating body is perpendicularly connected to the fifth radiating section, and another end of the second radiating body is perpendicularly connected to the third radiating body.

4. The antenna module of claim 3, wherein the third radiating body comprises a sixth radiating section, a seventh radiating section, an eighth radiating section, a ninth radiating section, and a tenth radiating section; the sixth radiating section is positioned on the first plane, an end of the six radiating section is perpendicularly connected to another end of the ground arm; the eighth, ninth, and tenth radiating sections are positioned on the second plane and connected to each other to form a step-shaped structure; the seventh radiating section is positioned on the third plane, and two ends of the seventh radiating section are perpendicularly connected to the sixth and the eighth radiating sections.

5. The antenna module of claim 2, wherein the parasitic resonator is positioned in a fourth plane parallel to the first and third planes, and wherein the parasitic resonator defines a coupling gap between the main antenna.

6. The antenna module of claim 5, wherein the parasitic resonator is substantially an L-shaped sheet, and the parasitic resonator comprises a first resonating section and a second resonating section perpendicularly connected to the first resonating section.

7. A wireless communication device comprising:

a circuit board, the circuit board comprising a feed point and a ground point;

a base plate perpendicularly mounted on the circuit board;

an antenna module assembled on the base plate, and comprising:

a main antenna comprising:

a feed arm;

a ground arm;

a first radiating body, the first radiating body connected to one end of the feed arm;

a second radiating body; and a third radiating body connected to one end of the ground arm, the first radiating body and the third radiating body are connected to the second radiating body and positioned at two sides of the second radiating body; and a parasitic resonator, the parasitic resonator positioned in a plane parallel to the main antenna, the parasitic resonator resonating with the main antenna and configured for widening a high frequency bandwidth of the main antenna.

8. The wireless communication device of claim 7, wherein the base plate comprises a first surface, a second surface opposite to the first surface, and a third surface interconnecting the first surface and the third surface; wherein the first radiating body comprises a first radiating section, a second radiating section, a third radiating section, a fourth radiating section, and a fifth radiating section; the first radiating section is attached to the first surface, an end of the first radiating section is perpendicularly connected to another end of the feed arm; the third, fourth, and fifth radiating sections are attached to the second surface and connected to each other to form a step-shaped structure; the second radiating section is attached to the third surface, and two ends of the second radiating section are perpendicularly connected to the first and third radiating sections.

9. The wireless communication device of claim 8, wherein the second radiating body is substantially a strip-shaped sheet, an end of the second radiating body is perpendicularly connected to the fifth radiating section, and another end of the second radiating body is perpendicularly connected to the third radiating body.

10. The wireless communication device of claim 9, wherein the third radiating body comprises a sixth radiating section, a seventh radiating section, an eighth radiating section, a ninth radiating section, and a tenth radiating section; the sixth radiating section is attached to the first surface, an end of the six radiating section is perpendicularly connected to another end of the ground arm; the eighth, ninth, and tenth radiating sections are attached to the second surface and connected to each other to form a step-shaped structure; the seventh radiating section is attached to the third surface, and two ends of the seventh radiating section are perpendicularly connected to the sixth and eighth radiating sections.

11. The wireless communication device of claim 8, wherein the parasitic resonator is positioned in the plane parallel to the first and third planes, and wherein the parasitic resonator defines a coupling gap between the main antenna.

12. The wireless communication device of claim 11, wherein the parasitic resonator is substantially an L-shaped sheet, and the parasitic resonator comprises a first resonating section and a second resonating section perpendicularly connected to the first resonating section.

13. An antenna module comprising:

a support structure having first and second opposing sides;

a feed point and a ground point;

an antenna pathway between said feed point and said ground point, the antenna pathway extending in sequence at least upward along the first side, laterally along the first side, extending from the first side onto the second side, in a downwardly extending step pattern along the second side, in an upwardly extending step pattern along the second side, and extending from the second side to the first side, laterally along the first side, and downward along the first side; and a parasitic resonator spaced from the antenna pathway, the parasitic resonator having a first portion parallel to the antenna pathway extending upward along the first side and a second portion parallel to the antenna pathway extending laterally along the first side.

14. The antenna module of claim 13, wherein the parasitic resonator defines a coupling gap between the main antenna.

15. The antenna module of claim 13, wherein the first radiating body comprises a first radiating section, a second radiating section, a third radiating section, a fourth radiating section, and a fifth radiating section; the first radiating section is positioned on a first plane, an end of the first radiating section is perpendicularly connected to another end of the feed arm; the third, fourth, and fifth radiating sections are positioned on a second plane parallel to the first plane and orderly connected to form a step-shaped structure; the second radiating section is positioned on a third plane perpendicular to the first and second planes, two ends of the second radiating section are perpendicularly connected to the first and third radiating sections.

16. The antenna module of claim 15, wherein the second radiating body is substantially a strip-shaped sheet, an end of the second radiating body is perpendicularly connected to the fifth radiating section, and another end of the second radiating body is perpendicularly connected to the third radiating body.

17. The antenna module of claim 16, wherein the third radiating body comprises a sixth radiating section, a seventh radiating section, an eighth radiating section, a ninth radiating section, and a tenth radiating section; the sixth radiating section is positioned on the first plane, an end of the six radiating section is perpendicularly connected to another end of the ground arm; the eighth, ninth, and tenth radiating sections are positioned on the second plane and orderly connected to each other to form a step-shaped structure; the seventh radiating section is positioned on the third plane, and two ends of the seventh radiating section are perpendicularly connected to the sixth and the eighth radiating sections.

18. The antenna module of claim 15, wherein the parasitic resonator is positioned in the plane parallel to the first and third planes, and defines a coupling gap between the main antenna.

19. The antenna module of claim 18, wherein the parasitic resonator is substantially an L-shaped sheet, and the parasitic resonator comprises a first resonating section and a second resonating section perpendicularly connected to the first resonating section.

* * * * *